US006598614B2

(12) United States Patent
Liu

(10) Patent No.: US 6,598,614 B2
(45) Date of Patent: Jul. 29, 2003

(54) FOLDABLE TENT FRAME

(76) Inventor: Lausan Chung-Hsin Liu, No. 243, Chien-Kuo Rd., Hsien-Tien City, Taipei Hsien (TW)

( * ) Notice: Subject to any disclaimer, the term of this patent is extended or adjusted under 35 U.S.C. 154(b) by 0 days.

(21) Appl. No.: 09/917,938

(22) Filed: Jul. 31, 2001

(65) Prior Publication Data

US 2003/0024563 A1 Feb. 6, 2003

(51) Int. Cl.[7] ..... E04H 15/38
(52) U.S. Cl. ..... 135/131; 135/158
(58) Field of Search ..... 135/131, 145, 135/158, 143, 146, 128, 144, 160, 123; 211/202, 200; 52/641, 645, 646, 655.1, 109; 248/277.1, 164, 166; 108/118

(56) References Cited

U.S. PATENT DOCUMENTS 4,607,656 A * 8/1986 Carter ..... 135/122
5,274,980 A * 1/1994 Zeigler ..... 135/123
5,421,356 A * 6/1995 Lynch ..... 135/145
5,634,483 A * 6/1997 Gwin ..... 135/115
5,701,923 A * 12/1997 Losi et al. ..... 135/131
5,794,640 A * 8/1998 Jang ..... 135/131
6,041,800 A * 3/2000 Carter ..... 135/130
6,129,102 A * 10/2000 Carter ..... 135/143
6,173,726 B1 * 1/2001 Talmadge ..... 135/122
6,206,020 B1 * 3/2001 Lynch ..... 135/128
6,412,507 B1 * 7/2002 Carter ..... 135/143
2002/0074032 A1 * 6/2002 Park et al. ..... 135/131

* cited by examiner

*Primary Examiner*—Daniel P. Stodola
*Assistant Examiner*—Jennifer E. Novosad
(74) *Attorney, Agent, or Firm*—Bacon & Thomas, PLLC

(57) ABSTRACT

A tent frame includes post sets located at four ends. Every two neighboring post sets engage respectively with a first linkage rod set and a second linkage rod set. The first linkage rod set of one post set and the second linkage rod set of a neighboring post set are pivotally engaged with each other through a first driven rod set and a second driven rod set which in turn are pivotally engaged with each other through toggle joints in a cross and staggered manner. There is a center pole located in the center of the tent frame engaging with four passive bar sets. Each of the passive bar sets attaches to the juncture of the first and second driven rod set. The first and second linkage rod sets, the first and second driven rod sets, and the passive bar sets are pivotally engaged with one another through toggle joints, and are movable by the post sets for extending or folding the tent frame.

8 Claims, 9 Drawing Sheets

FOLDABLE TENT FRAME

BACKGROUND OF THE INVENTION

The present invention relates to an improved tent frame and particularly a tent frame that is capable of folding conveniently and has a center pole located in the center for lifting the tent.

Conventional tent frames generally include a plurality of upright poles each coupled with a grommet. Two neighboring poles are pivotally engaged with two sets of a first and a second brace pole which are crossed with each other and are pivotally engaged on a pivotal shaft. The adjacent first and second brace pole between two upright poles engage respectively with a pivotal element. The first brace pole has two parallel connecting plates located in the center and, two separating sections extended in opposite directions which have respectively one end pivotally engaged with the connecting plate. One separating section has one end remote from the connecting plate and pivotally engaged with the pivotal element. Another separating section has one end remote from the connecting plate and pivotally engaged with the grommet. Two connecting plates form a passing groove allowing the second brace pole to run through. The second brace pole in the passing groove and the two connecting plates are pivotally engaged with the pivotal shaft. After assembly of aforesaid elements, the two separating sections pivotally engaged with the pivotal element may be set on a same surface.

Whereas adopting the construction set forth above, the tent is lifted only at supporting spots formed by supporting poles at four ends. The center portion of the tent does not have any support and tends to sag. To prevent this from happening, users must fasten the four ends of the tent and supporting poles tightly, or stretch the tent forcefully. It takes a lot of human labor to accomplish the task. An unevenly stretching on one side will decrease the stretching effect or even cause damage to the tent.

SUMMARY OF THE INVENTION

The primary object of the invention is to resolve the foregoing disadvantages. The invention provides a folding tent frame that has a center pole for lifting the tent. Moreover the invention has post sets located at four ends. Two neighboring post sets engage respectively with a first linkage rod set and a second linkage rod set. The first linkage rod set of one post set and the second linkage rod set of a neighboring post sets are engaged with each other through a first driven rod set and a second driven rod set which in turn are pivotally engaged with each other through toggle joints in a cross and staggered manner. The first and second driven rod sets engage with each other at a juncture which in turn engage with a passive bar set pointing toward the center. There are total four passive bar sets joining in the center to engage with the center pole. The first and second linkage rod sets, the first and second driven rod sets, and the passive bar sets are pivotally engaged with one another on toggle joints. The post sets may be moved away or towards the center pole and drive aforesaid rod sets and bar sets for extending or folding the tent frame.

The foregoing, as well as additional objects, features and advantages of the invention will be more readily apparent from the following detailed description, which proceeds with reference to the accompanying drawings.

DESCRIPTION OF THE PREFERRED EMBODIMENT

Figure 1A:
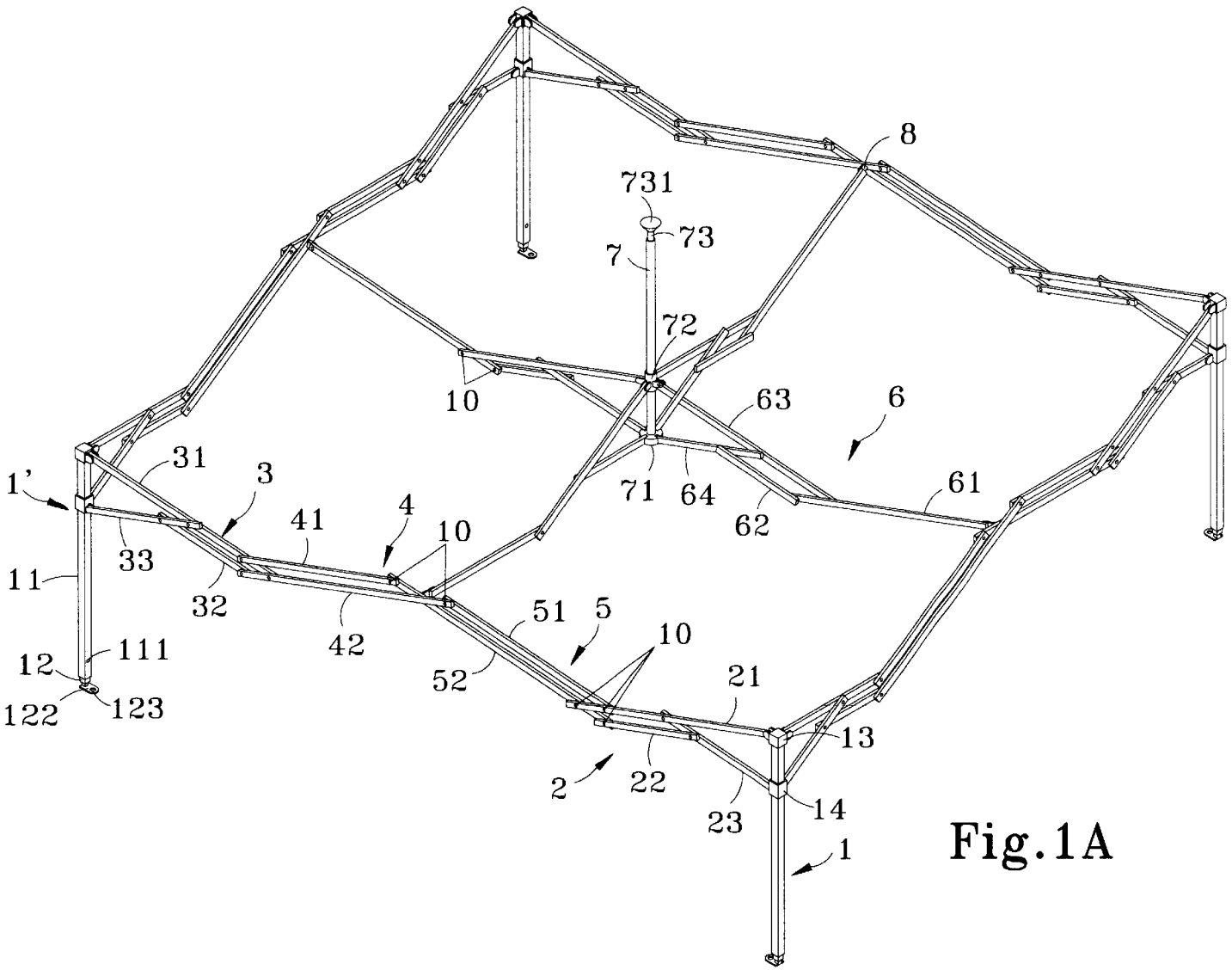
FIGS. 1A and 1B are perspective views of the invention.
Figure 2A:
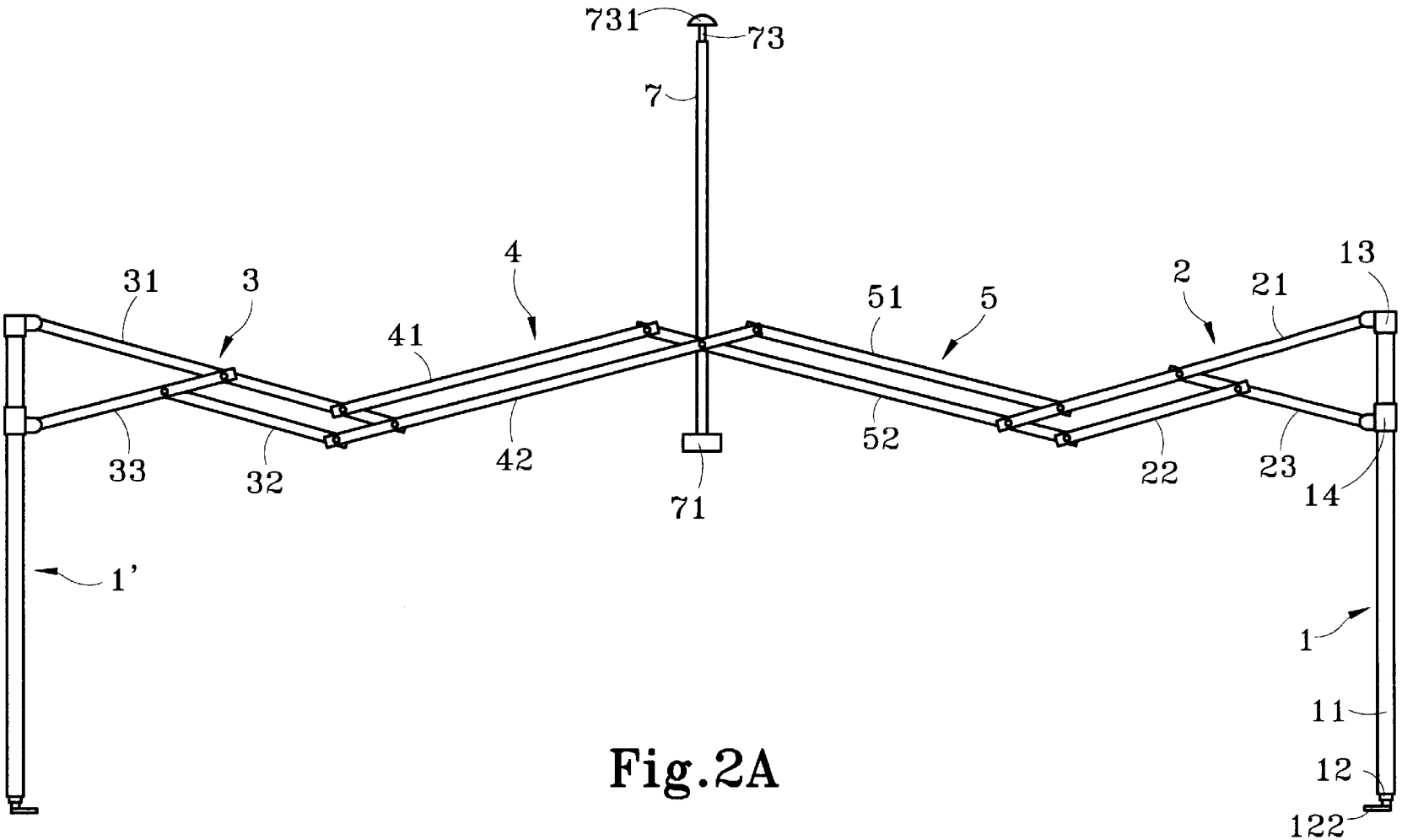
FIGS. 2A, 2B and 2C are schematic views of the rod sets of the invention at various folding states shown relative to the center pole and the post sets.
Figure 3A:
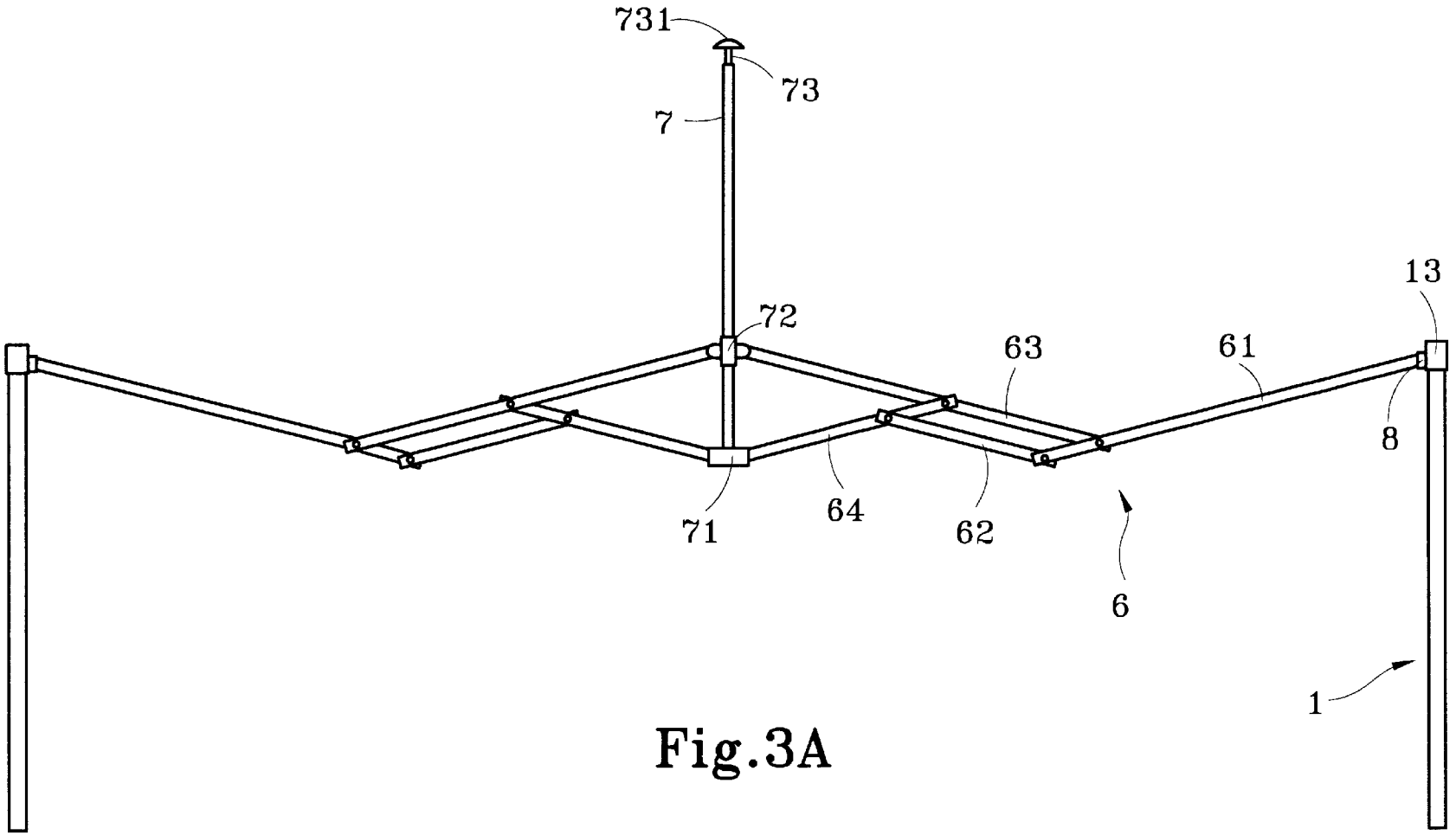
FIGS. 3A, 3B and 3C are schematic views of the passive bar sets of the invention at various folding states shown relative to the center pole and the post sets.

Referring to FIGS. 1A, 2A, and 3A, the tent frame of the invention includes post sets 1, 1' located at four ends of the tent frame. Two neighboring post sets 1, 1' engage respectively with a first linkage rod set 2 and a second linkage rod set 3. The first linkage rod set 2 of one post set 1 and the second linkage rod set 3 of a neighboring post set 1' engage with each other through a first driven rod set 4 and a second driven rod set 5 which in turn are pivotally engaged with each other through toggle joints 10 in a cross and staggered manner. The first and second linkage rod set 2, 3 have respectively a first main rod 21, 31 which has one end pivotally engaged with the post set 1, 1' and another end pivotally engaged with the first and second driven rod set 4, 5. The first and second linkage rod set 2, 3 also have respectively a first displacement rod 23, 33 which has one end pivotally engaged with a first sliding sleeve 14 movably coupled to the post set 1, 1' and another end pivotally engaged with the first main rod 21, 31. The first and second linkage rod set 2, 3 further have respectively a first secondary rod 22, 32 which has one end pivotally engaged with the first displacement rod 23, 33 and another end pivotally engaged with the first and second driven rod set 4, 5. The driven rod sets 4, 5 have respectively a second main rod 41, 51 pivotally engaged with the first main rod 21, 31, and a second secondary rod 42, 52 which are pivotally engaged with the first main rod 21, 31 and the first secondary rod 22, 32. The second secondary rod 42, 52 further are pivotally engaged with another ends of the second main rod 41, 51 and second secondary rod 42, 52 on toggle joints 10. There is a pivotal joint 13 mounted to the top end of the post set 1, 1' for pivotally engaging with the first main rod 21, 31.

In the center of the tent frame, there is a center pole 7 which is engaged with four passive bar sets 6. Each of the passive bar sets 6 engages with the juncture of the first and second driven rod set 4, 5. The juncture of the first and second driven rod set 4, 5 further engages with a bent transfer connection blade 8 which also engages with the passive bar set 6. The passive bar set 6 includes a main bracing bar 61 driven by the first and second driven rod set 4, 5. The main bracing bar 61 has one end pivotally engaged with a secondary bracing bar 62 and a second displacement rod 63. The second displacement rod 63 has one end pivotally engaged with a second sliding sleeve 72 movable on the center pole 7. The secondary bracing bar 62 has another end pivotally engaged with a pole bar 64. The pole bar 64 has one end pivotally engaged with the center pole 7 and another end pivotally engaged with the secondary displacement bar 63. The bottom end of the center pole 7 attaches to an anchor seat 71 which is pivotally engaged with the pole bar 64.

Figure 1B:
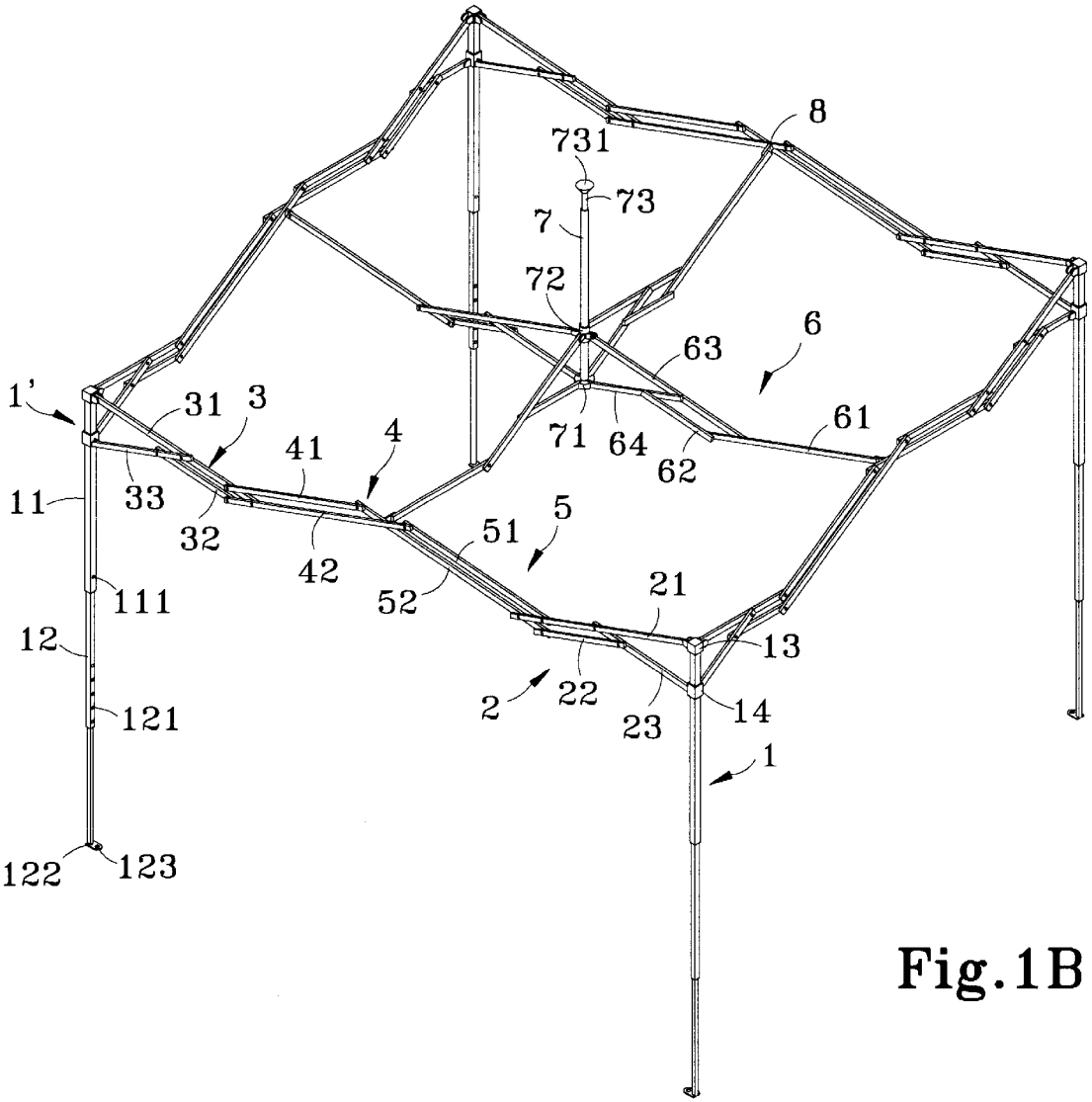

Referring to FIG. 1B, the post set 1, 1' has a main pole 11 and at least one secondary pole 12 which has a smaller exterior diameter than the main pole 11 and is housed in the main pole 11 in a telescopic and extensible manner. The main pole 11 and secondary pole 12 have respectively an anchor strut 111 and a matching anchor bore 121 for adjusting the height of the tent frame to suit ground environments. The secondary pole 12 has a bottom end attached to a pedestal 122 which has apertures 123 formed thereon to allow fasteners (not shown in the drawings) to run through and nail to the ground for fastening the tent frame securely. Moreover, the center pole 7 houses at least one tent pole 73 therein in an extensible manner. The tent pole 73 has a top end attached to a pole cap 731 for supporting the tent. Such a construction may be used to adjust the lifting height of the tent.

Figure 2B:
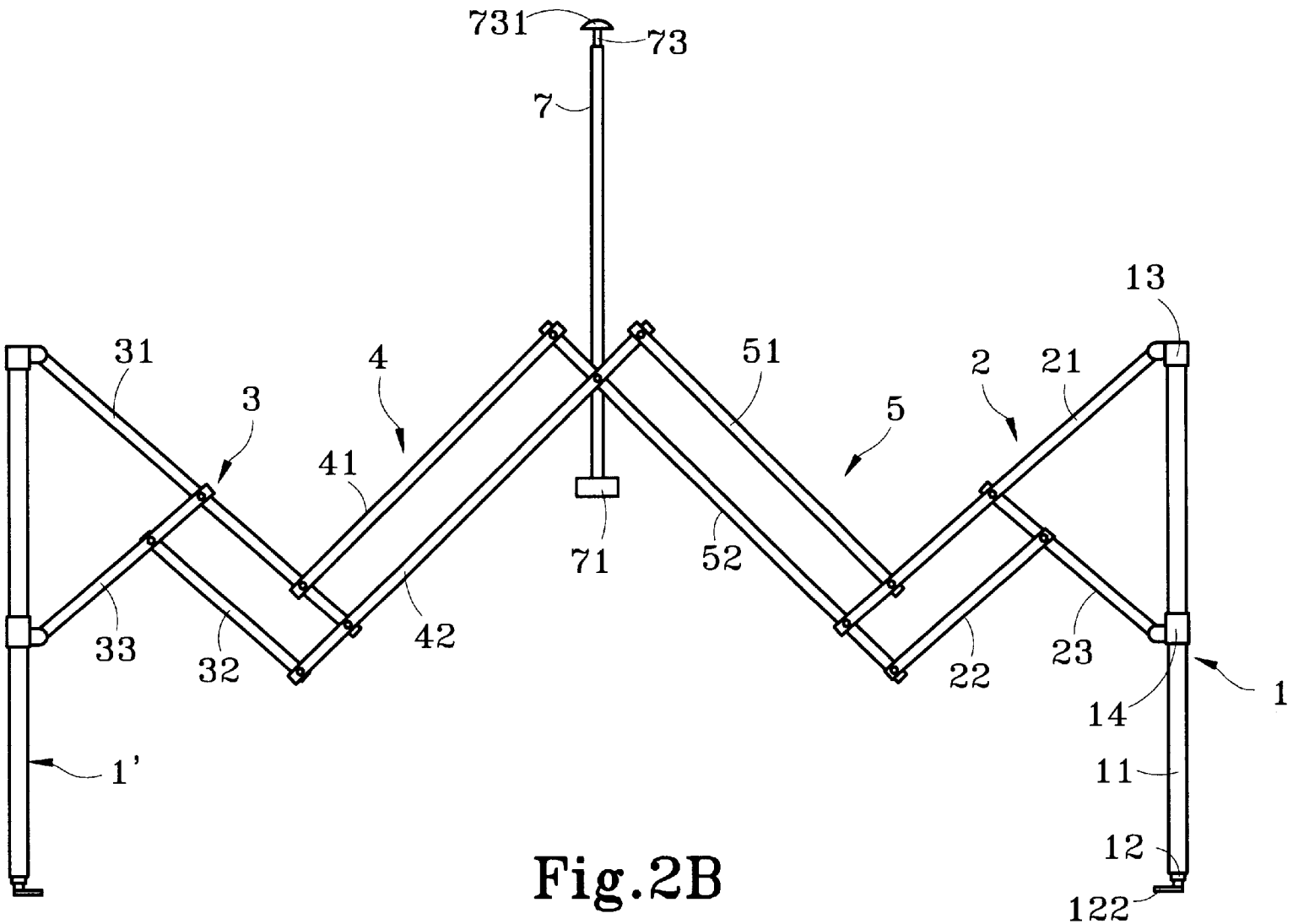
Figure 2C:
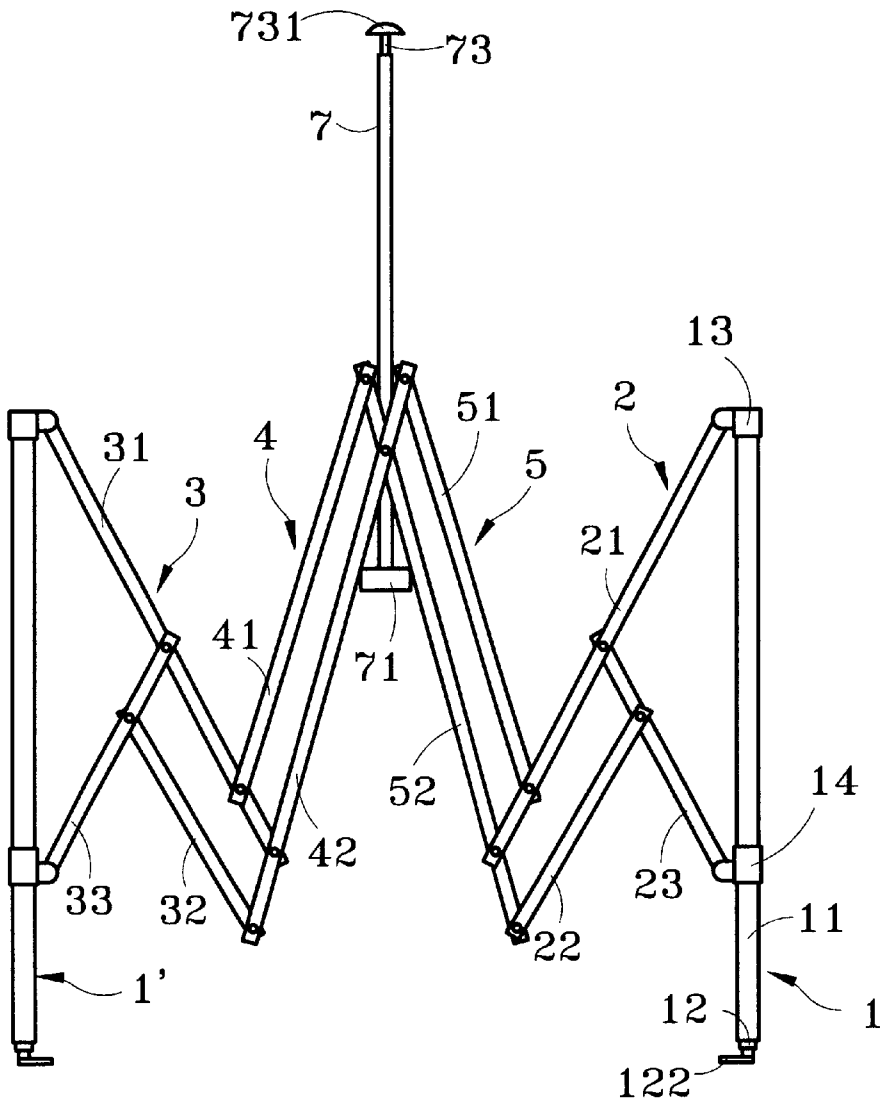

Referring to FIGS. 2A, 2B and 2C, when to fold the tent frame, apply force on the post sets 1, 1' and move towards the center pole 7, as the first main rods 21, 31 are pivotally engaged with the first sliding sleeve 13 on the top end of the post sets 1, 1' and have another end pivotally engaged with the first displacement rods 23, 33, and the second main and secondary rods 41, 51, 42, 52, when the post sets 1, 1' are moving towards the center pole 7, the first main rods 21, 31 will also drive and move the first displacement rods 23, 33 to push the first sliding sleeve 14 downwards on the post sets 1, 1', and the first secondary rods 22, 32 being pivotally engaged with the first displacement rods 23, 33 will be moved, and also drive the first main rods 21, 31 and second main and secondary rods 41, 51, 42, 52 of the first driven rod set 4, 5 to move and fold about the toggle joints thereby to make the post sets 1, 1' folding and juxtaposing closely.

Figure 3B:
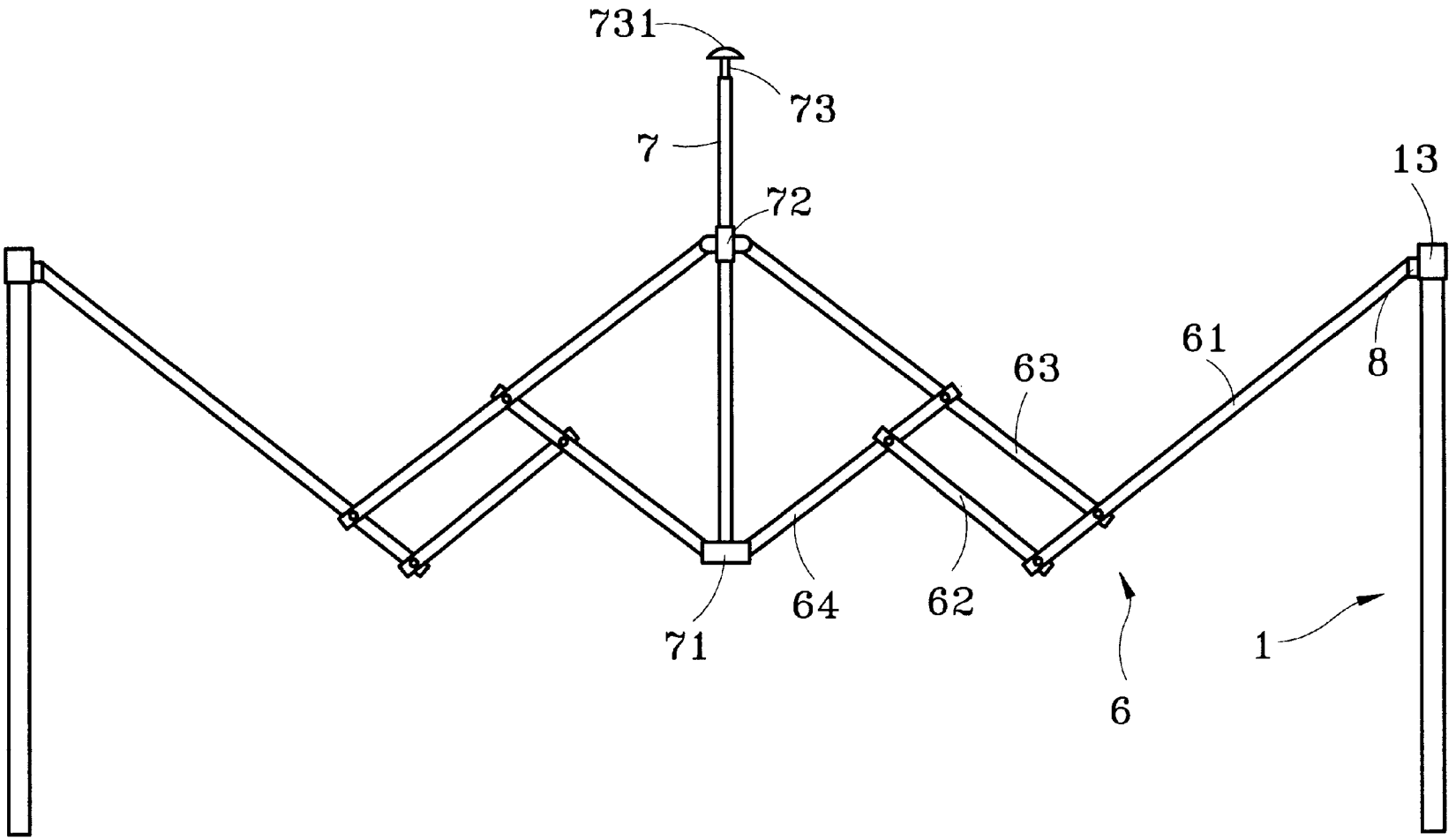
Figure 3C:
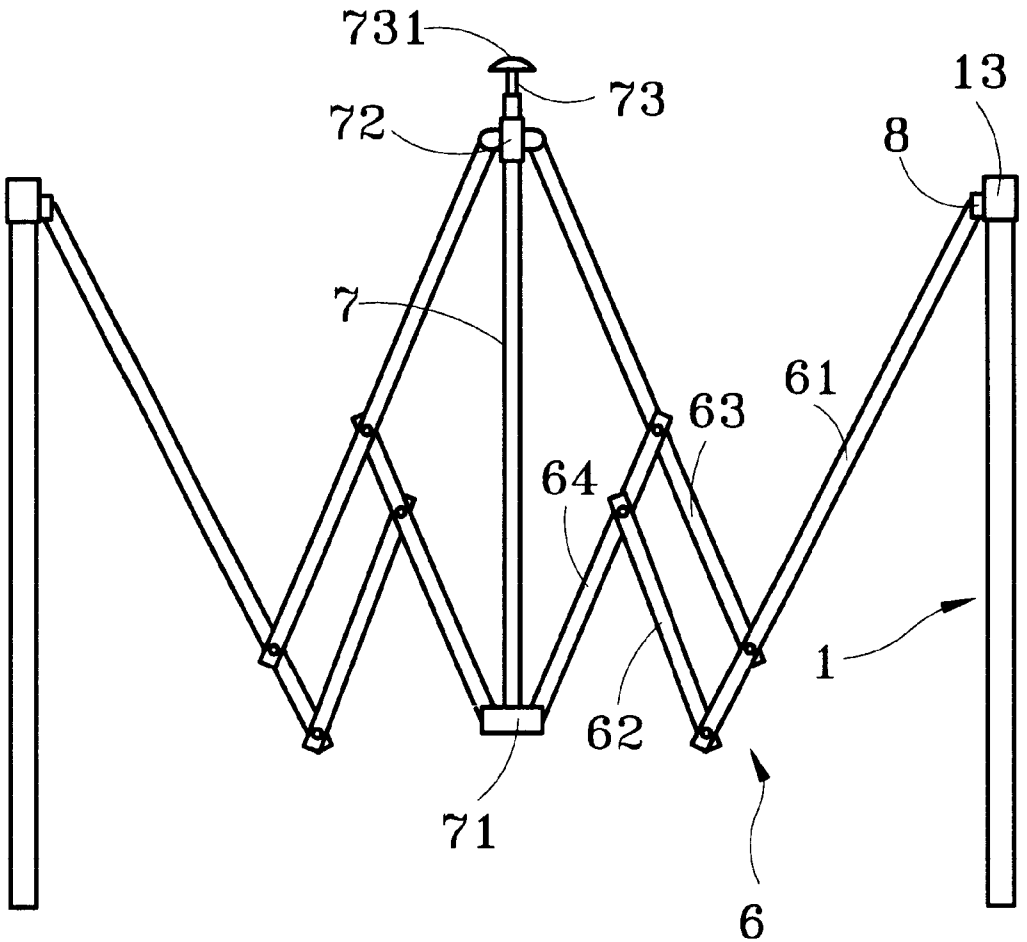
Figure 4:
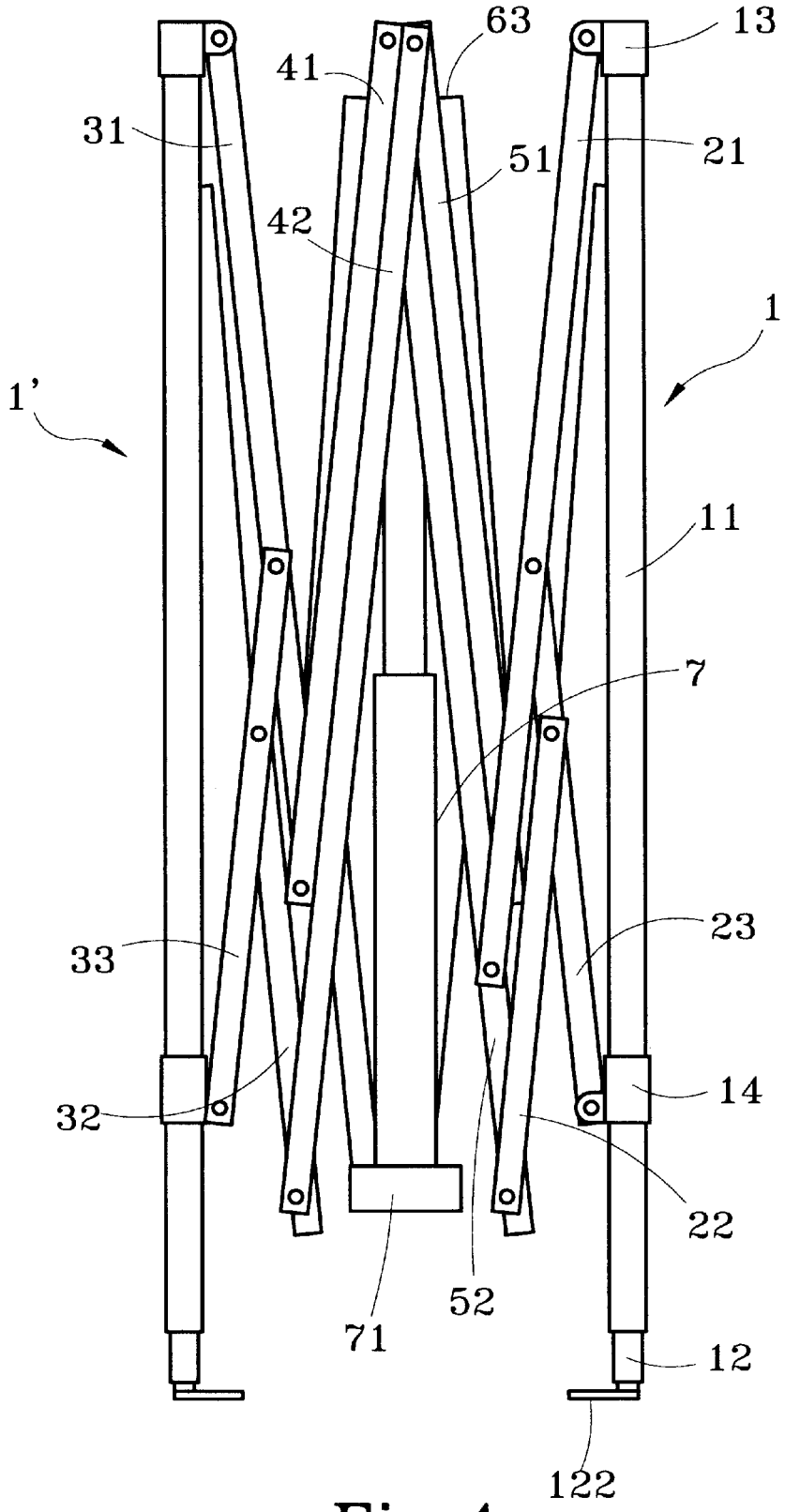
FIG. 4 is a schematic view of the invention, after folding.

Referring to FIGS. 3A, 3B and 3C for other views of the folding conditions of the invention, when the post sets 1, 1' are moved towards the center pole 7 with straight force, the transfer connection blade 8 will be pushed by the juncture of the first and second driven rod sets 4, 5 and moves the main bracing bar 61 of the passive bar set 6, and also move the second displacement rod 63 and the secondary bracing bar 62 which are pivotally engaged with the main bracing bar 61, and the pole bar 64 which has one end pivotally engaged with the main and secondary bracing bar 61, 62 and another end pivotally engaged with the anchor seat 71 located at the bottom end of the center pole 7. As the rods and bars set forth above are pivotally engaged through toggle joints, the second displacement rod 63 will push the second sliding sleeve 72 upwards on the center pole 7 and allow the post sets 1, 1' moving towards the center pole 7 for folding and juxtaposing closely.

What is claimed is:

1. A tent frame, comprising:

post sets each located at one end of four ends of the tent frame, every two neighboring post sets engaging respectively with a first linkage rod set and a second linkage rod set, the first linkage rod set of one of the post sets and the second linkage rod set of a neighboring one of the post sets being pivotally engaged with each other through a first driven rod set and a second driven rod set which in turn are pivotally engaged with each other in a cross and staggered manner, the first and the second linkage rod sets each including respectively a first main rod which has one end pivotally engaged with one of the post sets and another end pivotally engaged with a respective one of the first and the second driven rod sets, a first displacement rod which has one end pivotally engaged with a first sliding sleeve movably coupled with the post set and another end pivotally engaged with the first main rod, and a first secondary rod which has one end pivotally engaged with the first displacement rod and another end pivotally engaged with the first and the second driven rod sets, the first and the second driven rod sets each including respectively a second main rod which is pivotally engaged with the first main rod and a second secondary rod which is pivotally engaged with the first main rod and the first secondary rod, the second secondary rod further being pivotally engaged with an end of the second main rod of a neighboring linkage rod set;

a center pole located in a center of the tent frame engaging with four passive bar sets, each of the passive bar sets being engaged with a juncture of the first and the second driven rod sets, each of the passive bar sets including a main bracing bar driven by the first and second driven rod sets, the main bracing bar having one end pivotally engaged with a secondary bracing bar and a second displacement rod, the second displacement rod having one end pivotally engaged with a second sliding sleeve movably coupled with the center pole, the secondary bracing bar having another end pivotally engaged with a pole bar, the pole bar having one end pivotally engaged with the center pole and another end pivotally engaged with the second displacement rod; and wherein the first linkage rod sets, the second linkage rod sets, the first driven rod sets, the second driven rod sets and the passive bar sets are pivotally engaged with one another through toggle joints, and are movable by the post sets for extending or folding the tent frame when the post sets are moved away or towards the center pole.

2. The tent frame of claim 1, wherein the top end of each of the post sets is attached to a pivotal joint for pivotally engaging with the first main rods.

3. The tent frame of claim 1, wherein the first and the second driven rod sets join at a juncture which attaches to a bent transfer connection blade for engaging with the passive bar set.

4. The tent frame of claim 1, wherein the bottom end of the center pole attaches to an anchor seat which is pivotally engaged with the pole bar.

5. The tent frame of claim 1, wherein each of the post sets includes a main pole and at least one secondary pole which has a smaller exterior diameter than the main pole and is housed in the main pole in a telescopic and extensible manner.

6. The tent frame of claim 5, wherein the main pole and the secondary pole have respectively an anchor strut and a matching anchor bore for adjusting the extension length thereof.

7. The tent frame of claim 5, wherein the secondary pole has a bottom end attached to a pedestal for resting on the ground, the pedestal having apertures formed thereon.

8. The tent frame of claim 1, wherein the center pole houses at least one tent pole therein in an extensible manner, the tent pole having a top end attached to a pole cap for supporting a tent.

* * * * *